US006837806B1

(12) United States Patent
Sajima

(10) Patent No.: US 6,837,806 B1
(45) Date of Patent: Jan. 4, 2005

(54) GOLF BALL

(75) Inventor: Takahiro Sajima, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/707,944

(22) Filed: Nov. 8, 2000

(30) Foreign Application Priority Data

Nov. 8, 1999 (JP) ..... 11-316709

(51) Int. Cl.[7] ..... A63B 37/12; A63B 37/14
(52) U.S. Cl. ..... 473/384; 473/378
(58) Field of Search ..... 473/378, 379, 473/380, 381, 382, 383

(56) References Cited

U.S. PATENT DOCUMENTS 4,142,727 A 3/1979 Shaw et al.
4,258,921 A * 3/1981 Worst ..... 40/327
4,722,529 A * 2/1988 Shaw et al. ..... 473/381
4,869,512 A 9/1989 Nomura et al.
5,106,096 A * 4/1992 Dunn ..... 473/383
5,292,132 A 3/1994 Oka

FOREIGN PATENT DOCUMENTS

JP 57-22595 5/1982
JP 64-8982 1/1989
JP 4-347177 12/1992

* cited by examiner

*Primary Examiner*—Gregory Vidovich
*Assistant Examiner*—Alvin A. Hunter, Jr.
(74) *Attorney, Agent, or Firm*—Birch, Stewart, Kolasch & Birch, LLP

(57) ABSTRACT

An upper hemisphere (2) of a golf ball can be divided into five units (7) by five circular arcs (6) extending from a pole (4) to a great circle zone (5). Similarly, a lower hemisphere can be divided into five units (7). The dimple patterns of the respective units (7) are equivalent to each other. Each unit (7) has four first predetermined polygons (8) whose entirety is included therein and two first predetermined polygons (8) whose half is included therein. The number of the first predetermined polygons (8) that can be formed on the surface of the golf ball is 50. The golf ball has 50 large flat portions present in a region other than a region proximate to a great circle zone (5).

8 Claims, 15 Drawing Sheets

GOLF BALL

BACKGROUND OF THE INVENTION

1. Field of the Invention

Generally, the present invention relates to a golf ball and more particularly to a dimple pattern of the golf ball.

2. Description of the Related Art

Normally, the golf ball has 280–540 dimples on its surface. The role of the dimple lies in accelerating transition of turbulent flows of a boundary layer by making air flows in the periphery of the golf ball turbulent to thereby cause separation of the turbulent air flows (hereinafter referred to as "effect of turbulent flow") while it is flying. The acceleration of the transition of the turbulent air flows allows air to be separated from a rear point of the golf ball and a pressure drag to be low to thereby increase the flight distance thereof. Owing to the acceleration of the transition of the turbulent air flows, it is possible to space the separation point at upper side of the golf ball away from that at the lower side thereof and thereby improve a lift acting on the golf ball. Therefore, it can be said that a dimple pattern capable of accelerating the transition of the turbulent air flows, namely, capable of making the air flow turbulent is aerodynamically superior.

Researches and investigations have been made on the dimple pattern. For example, in Japanese Patent Publication No. 57-22595, there is disclosed a golf ball having the flat portion (region other than dimple-forming region) with a predetermined area formed on its surface. Because the flat portion is present on the surface of the golf ball, the golf ball has a comparatively small region covered with the dimples on its surface. This, the effect of a turbulent flow is displayed insufficiently and thus the golf ball is aerodynamically unsatisfactory.

There are proposed golf balls having dimples formed on their surfaces as densely as possible to enhance their flight performances. For example, in Japanese Patent Application Laid-Open No. 64-8982, there is disclosed a golf ball having a surface area occupancy percentage (a value obtained by dividing the total sum of the area of all dimples formed on the golf ball by the surface area of an imaginary sphere having a diameter equal to that of the golf ball) at 65% or more. As another example, in Japanese Patent Application Laid-Open No. 9-347177, there is disclosed a golf ball having 40 flat portions or less in which rectangles each having an area larger than a predetermined area is formed.

Normally, the golf ball is shaped by using a pair of semispherical upper and lower dies. In molding a material of the golf ball, a part thereof flows out from a seam (parting line) between the upper and lower half dies. As a result, an annular burr is formed on; the surface of the golf ball. The burr is abraded with a whetstone or the like to remove it from the surface of the golf ball after the molding process terminates. Normally, no dimples are formed on the parting line to allow a region to be abraded to be flat to thereby abrade the region easily. Consequently, a great circle is formed on the portion (hereinafter referred to as "seam") corresponding to the parting line on the golf ball. The annular region containing the great circle constitutes a great circle zone not intersecting with dimples.

The above-described golf ball on which dimples are arranged densely is superior in its flight performance. Thus, a golfer can send the golf ball flying a long distance. However, golfers; desire to obtain a longer flight. Thus, golf ball makers are demanded to produce a golf ball having a longer flight. In the golf ball on which dimples are arranged densely, there is a big difference between the density of dimple arranged in the great circle zone and the density of dimples arranged in the region other than the great circle zone. Therefore, the golf ball does not look fine and its aerodynamic symmetrical property is insufficient.

SUMMARY OF THE INVENTION

The present invention has been made in view of the above-described problem. Thus, it is an object of the present invention to provide a golf ball having an improved flight performance and a small difference between the density of dimples arranged in a great circle zone and the density of dimples arranged in a region other than the great circle zone.

In order to achieve the object, according to the present invention, there is provided a golf ball having 360 dimples and only one great circle zone not intersecting with the dimples formed on a surface of the golf ball such that a surface area occupancy percentage of the dimples is 70% or more. Two or more rectangles each having a shorter side of 1.0 mm and a longer side of 2.4 mm and not containing any of the dimples can be formed in each of large flat portions formed in the range of 16 to 60 both inclusive in a region other than a region proximate to the great circle zone, without the rectangles separating from each other and with the rectangles overlapping each other in an area not more than a half of an entire area of each thereof.

In the golf ball, the large flat portion which has been regarded as unfavorable from the viewpoint of its flight performance is positively formed. The presence of the large flat portion causes dimples to be arranged sparsely and densely in the region other than the great circle zone. Owing to the difference in the density of the dimples formed on the surface of the golf ball, the effect of a turbulent flow can be displayed. The number of the large flat portions is set to the range of 16 to 60 both inclusive, and the surface area occupancy percentage of the dimples is 70% or more. Thus, the effect of the turbulent flow that is caused by respective dimples can be maintained substantially. Needless to say, to some extent, the presence of the large flat portion may decrease the effect of the turbulent flow that is caused by the respective dimples. However, the effect of the turbulent flow that is caused by the difference in the density of the dimples on the surface of the golf ball exceeds the decrease. Thus, in total, the large flat portion serves as a means for improving the flight performance of the golf ball.

The large flat portion serves as a means for preventing the difference between the density of dimples arranged in the great circle zone and the density of dimples arranged in the region other than the great circle zone from becoming large, thus improving the appearance of the golf ball. Further, it is possible to suppress the difference between the flight performance at the time when the hitting point of the golf ball at which the circumferential speed of the back spin thereof is highest is coincident with the great circle zone and the flight performance at the time when the hitting position of the golf ball at which the circumferential speed of the back spin thereof is highest is uncoincident therewith. Therefore, the large, flat portion serves as a means for improving the aerodynamic symmetrical property of the golf ball.

In the large flat portion, it is possible to form rectangles (hereinafter referred to as "predetermined rectangle") each having the shorter side of 1.0 mm and the longer side of 2.4 mm and not including a dimple. Two predetermined rectangles or more can be formed in one large flat portion, without the predetermined rectangles separating from each other and with the predetermined rectangles overlapping each other in an area not more than the half of the entire area of each thereof. Thereby, the area of the large flat portion is large, and thus the effect of the turbulent flow can be enhanced because of the difference generated in the density of the dimples on the surface of the golf ball. When too many predetermined rectangles are formed, a dimple-forming region becomes too small. Consequently, the effect of the turbulent flow that is caused by the respective dimples decreases. Thus, it is favorable not to form the large flat portion containing six predetermined rectangles or more that can be formed, with the predetermined rectangles overlapping each other in an area not more than the half of the entire area of each thereof. It is mire favorable not to form the large flat portion containing four predetermined rectangles or more that can be formed as described above. That is, in each large flat portion, it is ideal to form the large flat portion containing two or three predetermined rectangles that can be formed, with the predetermined rectangles overlapping each other in an area not more than the half of the entire area of each thereof.

Large flat portions are formed in the range of 16 to 60 both inclusive in the region other than the region proximate to the great circle zone. The effect of the turbulent flow that is caused by the difference in the density of the dimple on the surface of the golf ball can be sufficiently displayed by setting the number of the large flat portions to 16 or more. It is possible to suppress decrease of the effect of the turbulent flow that is caused by the respective dimples by setting the number of the large flat portions to 60 or less. From this point of view, favorably, the number of the large flat portions present on the surface of the golf ball in the region other than the region proximate to the great circle zone is set to the range of 20 to 56 both inclusive and more favorably to the range of 20 to 50 both inclusive.

The great circle zone is a continuous flat portion. But the region proximate to the great circle zone is not counted as the large flat portion. That is, the large flat portion that can be counted is only the large flat portion in which two or more predetermined rectangles are formed in the region other than the region proximate to the great circle zone, without the predetermined rectangles separating from each other and with the predetermined rectangles overlapping each other in an area not more than the half of the entire area of each thereof. The term "the region proximate to the great circle zone" which is used in the pre sent specification means the region spaced from the great circle corresponding to the seam at less than 3% of the diameter of the golf ball.

Let it be supposed that two flat portions or more are continuous with each other. In this case, when the predetermined rectangles can be formed in each of the flat portions, with the flat portions separated from each other, the flat portions are not regarded as the large flat portion. Let it be supposed that two flat portions or more are continuous with each other. In this case, when two predetermined rectangles or more can be formed in each of the flat portions, without the predetermined rectangles separating from each other and with the predetermined rectangles overlapping each other in an area not more than the half of the entire area of each thereof, the respective flat portions are regarded as the large flat portions.

In the case where two predetermined rectangles or more can be formed in one flat portion, with the predetermined rectangles overlapping each other in an area more than the half of the entire area of each thereof, the flat portion is not regarded as the large flat portion.

Because the surface of golf ball is curved, a figure which is drawn in the large flat portion has strictly a three-dimensional configuration. However, the figure drawn in the large flat portion is much smaller than the imaginary sphere of the golf ball. Thus, the figure is approximated to a two-dimensional configuration. That is, the term "rectangle" used in the present specification means a rectangle whose side is circular arc-shaped. Thus, the length of the circular arc is measured as the length of the side of the rectangle.

In the golf ball of the present invention, the surface area occupancy percentage of the dimple is 70% or more. Thereby, in the golf ball having the large flat portion, the effect of the turbulent flow that is caused by the respective dimples can be maintained to some extent. From this point of view, it is preferable to set the surface area occupancy percentage to 74% or more. The effect of the turbulent flow that is caused by the respective dimples can be displayed increasingly, as the surface area occupancy percentage becomes higher. Thus, in the present invention, the upper limit of the surface area occupancy percentage cannot be set. However, because the golf ball of the present invention has the large flat portion, the surface area occupancy percentage is necessarily set to favorably 84% or less and more favorably 80% or less.

The golf ball of the present invention has 360 dimples or more. Thereby, in the golf ball having the large flat portion, the effect of the turbulent flow that is caused by the respective dimples can be maintained to some extent. From this point of view, it is preferable that the golf ball has 400 or more dimples. When the golf ball has too many dimples formed on the surface thereof, the trajectory of the golf ball will be low and other problems will occur. Thus, it is favorable that the golf ball has 500 dimples or less. It is more favorable that the golf ball has 450 dimples or less.

Favorably, rectangles are formed in the range of 32 to 120 both inclusive in the large flat portions formed in the region other than the region proximate to the great circle zone without the rectangles separating from each other and with the rectangles overlapping each other in an area not more than a half of an entire area of each thereof. The effect of the turbulent flow that is caused by the difference in the density of the dimple on the surface of the golf ball can be sufficiently enhanced by setting the total sum of the predetermined rectangles to 32 or more. It is possible to suppress decrease of the effect of the turbulent flow that is caused by the respective dimples by setting the total sum of the predetermined rectangles to 120 or less. From this point of view, more favorably, the total sum of the predetermined rectangles is set to the range of 40 to 112 both inclusive and most favorably to the range of 40 to 100 both inclusive.

Favorably, rectangles each having a shorter side of 1.0 mm and a longer side of 2.4 mm are formed in the large flat portions formed in the region other than the region proximate to the great circle zone, without the rectangles separating from each other and with: the rectangles overlapping each other in an area not more than a half of an entire area of each thereof, such that the total of areas of polygons (hereinafter referred to as "predetermined polygon") each consisting of a combination of the rectangles lies in the range of 50 $mm^2$ to 400 $mm^2$. The effect of the turbulent flow that is caused by the difference in the density of the dimple on the surface of the golf ball can be sufficiently enhanced by setting the total sum of the areas of the predetermined polygons to 50 $mm^2$ or more. It is possible to suppress decrease of the effect of: the turbulent flow that is caused by the respective dimples by setting the total sum of the areas of the predetermined polygons to 400 $mm^2$ or less.

From this point of view, more favorably, the total sum of the area of predetermined polygons its set to the range of 90 $mm^2$ to 360 $mm^2$ both inclusive. In computing the area of the predetermined polygon, the predetermined rectangle is formed in the large flat portion to overlap them each other in a possible smallest area.

Favorably, the diameter of a minimum circle containing the predetermined polygon consisting of a combination of the predetermined rectangles is 8 mm or less. Thereby, it is possible to prevent the large flat portion from becoming-too large and suppress the decrease of the effect of she turbulent flow that is caused by the respective dimples. From this point of view, the diameter of the minimum circle is more favorably 6 mm or less and most favorably 4 mm or less. Two rectangles or more are formed in the minimum circle, without the predetermined rectangles separating from each other and with the predetermined rectangles overlapping each other in an area not more than a half of an entire area of each thereof. Accordingly, the lower limit of the diameter of the minimum circle is favorably 2.8 mm or more. In computing the diameter of the minimum circle, the predetermined rectangle is formed in the minimum circle to overlap them each other in a possible smallest area.

The size of the dimple is not limited to a specific one. However, normally, the diameter of the dimple is set to the range of 2.0 mm to 5.0 mm both inclusive. The depth thereof is set to the range of 0.10 mm to 0.30 mm both inclusive. The total sum of the volumes of the dimples is set to the range of 250 $mm^3$ to 450 $mm^3$. The diameter is measured by drawing common tangents to the curve of the dimple at both ends in section and measuring the distance between both points of contact. The depth means the distance of a perpendicular drawn from the common tangent to the deepest point of the dimple. The volume of the dimple means the volume of the space surrounded with the plane including the outer edge of the dimple and the surface thereof.

DETAILED DESCRIPTION OF THE PREFERRED EMBODIMENTS

The present invention will be described below with reference to drawings.

Figure 1:
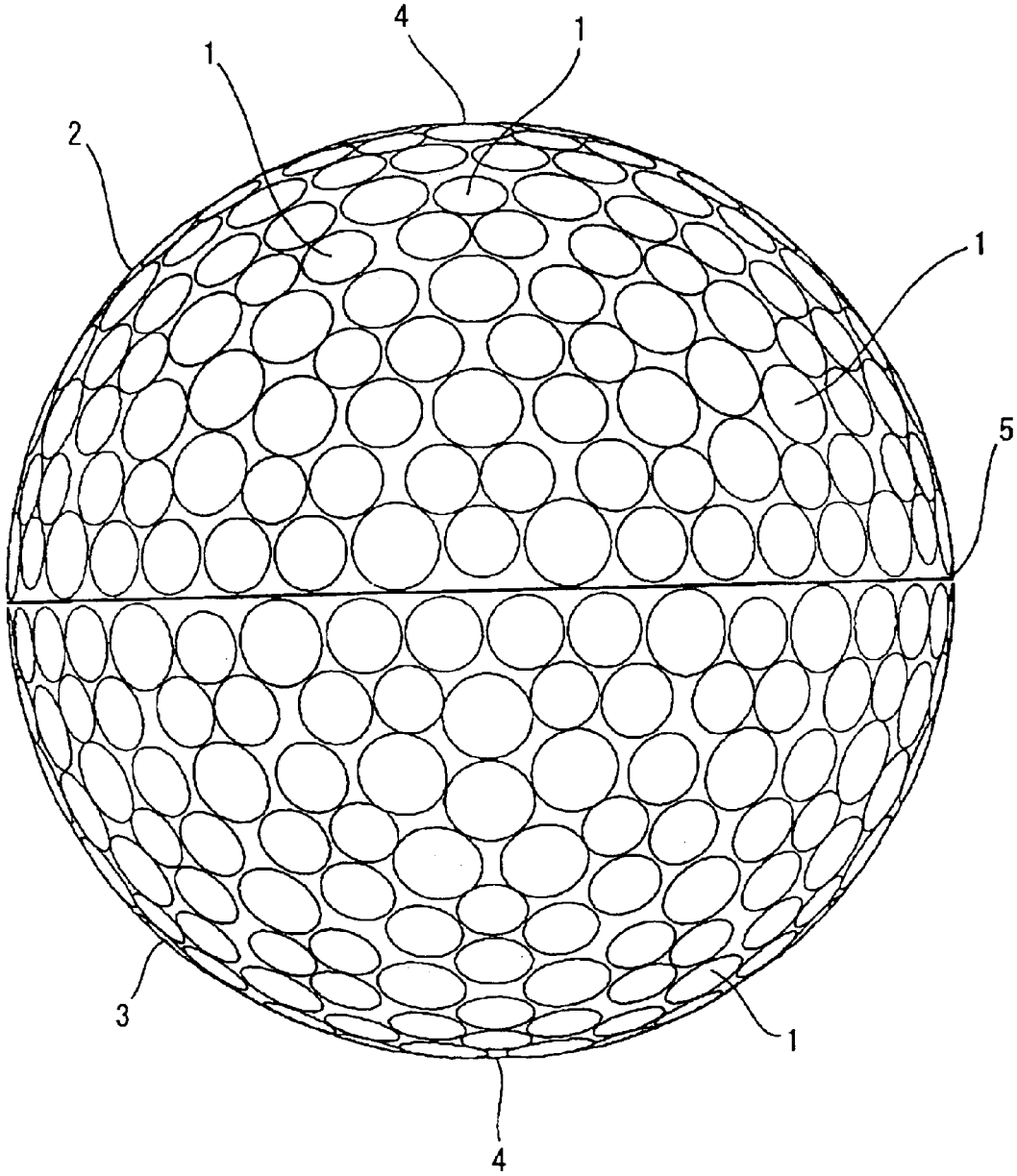
FIG. 1 is a front view a golf ball of an embodiment of the present invention.

FIG. 1 shows a golf boll of an embodiment of the present invention. The golf ball has a diameter in the range of 42.67 mm to 43.00 mm both inclusive. The golf ball has a large number of dimples 1 on its surface. The golf ball is molded with semispherical upper and lower dies. The golf ball has an upper hemisphere 2 corresponding to the upper die and a lower hemisphere 3 corresponding to the lower die. The uppermost point of the upper hemisphere 2 and the lowermost point of the lower hemisphere 3 are poles 4. The region proximate to the boundary between the upper hemisphere 2 and the lower hemisphere 3 is a great circle zone 5 not intersecting with dimples 1. The center of the golf ball 5 is coincident with the seam.

Figure 2:
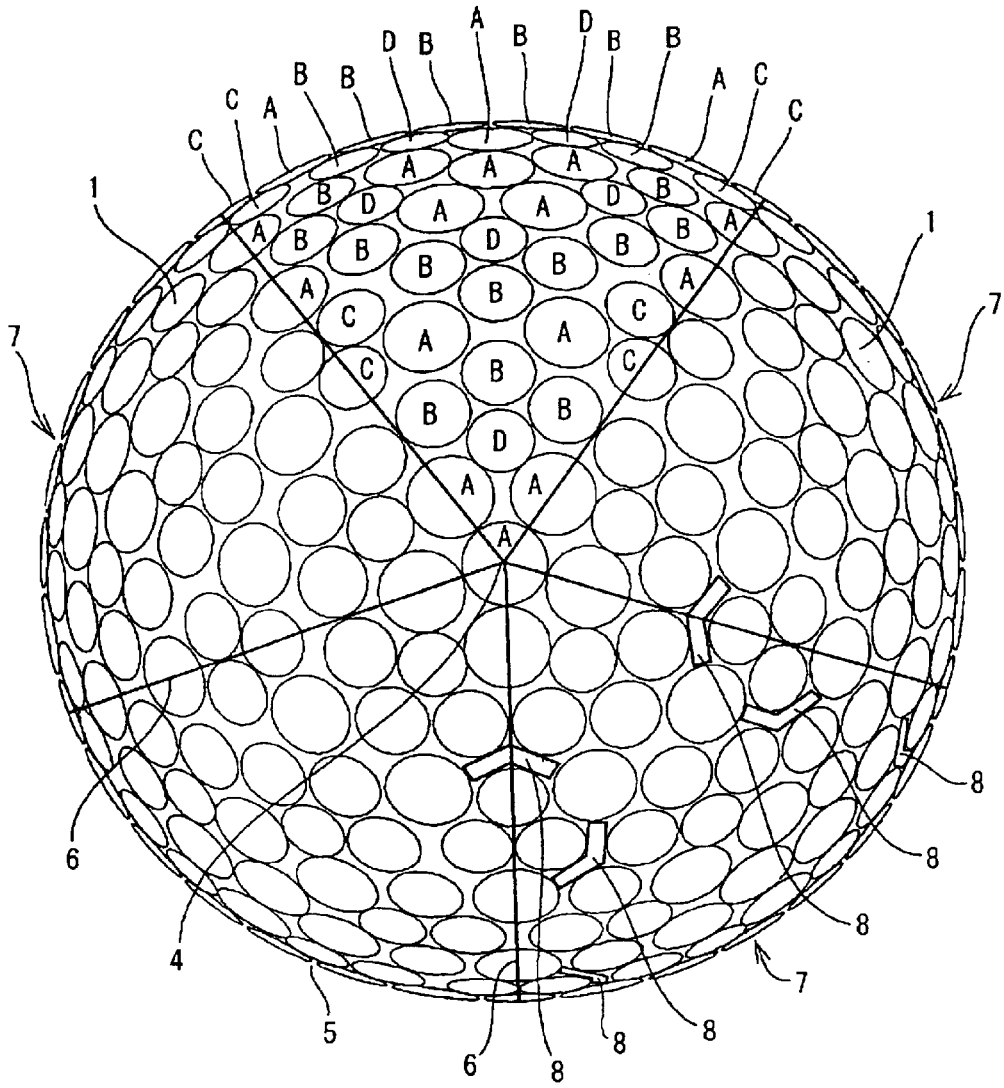
FIG. 2 is a plan view showing the golf ball shown in FIG. 1.

FIG. 2 is a plan view showing the golf ball shown in FIG. 1. FIG. 2 shows only the upper hemisphere 2 whose center is the pole 4 and periphery is the great circle zone 5. As shown in FIG. 2, the upper hemisphere 2 can be divided into five units 7 by five circular arcs 6 extending from the pole 4 to the great circle zone 5. The dimple patterns of the respective units 7 are equivalent to each other. That is, in the upper hemisphere 2, the dimple pattern of one unit 7 is rotated five times on the pole 4 to form it in the five units 7. The number of the repetition times is not limited to five times but is set to four times to eight times. By setting the number of the repetition times to four times or more, it is possible to prevent the golf ball from its flight performance being varied, depending on a hitting point. By setting the number of, the repetition times to eight times or less, it is possible to prevent the dimples 1 from being arranged regularly and thus increase the effect of the turbulent flow. Although not shown, the lower hemisphere 3 has also five units 7 same as those of the upper hemisphere 2.

The golf ball has 132 dimples A each having a diameter 4.00 mm, 180 dimples B each having a diameter 3.45 mm, 60 dimples C each having a diameter 3.30 mm, and 60 dimples D each having a diameter 3.15 mm. FIG. 2 shows the kind (dimples A through D) of the dimple 1 formed in only one unit 7. The golf ball has 432 dimples.

As shown in FIG. 2, a first predetermined polygon 8 can be formed on the surface of the golf ball. In FIG. 2, four of the first predetermined polygons 8 whose entirety is included in one unit 7 are drawn, and two of the first predetermined polygons 8 whose half is included in one unit 7 are drawn. That is, in one unit 7, five of the first predetermined polygons (4+0.5×2) 8 are included in one unit 7. As described previously, because the golf ball has five units 7 on its upper hemisphere 2 and its lower hemisphere 3, respectively, the golf ball has 10 units 7 in total. Therefore, the number of the first predetermined polygons 8 that can be formed on the golf ball is 50 (5×10). Accordingly, the golf ball has 50 large flat portions present in: the region other than the region proximate to the great circle zone 5.

Figure 3:
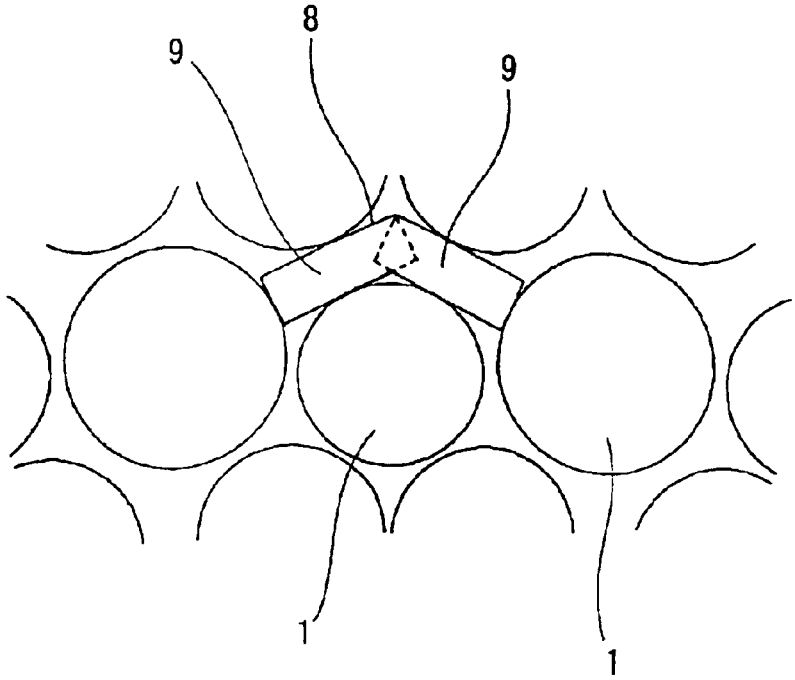
FIG. 3 is an enlarged view showing a first predetermined polygon of the golf ball shown in FIGS. 1 and 2 and the region proximate thereto.

FIG. 3 is an enlarged view showing one of the first predetermined polygons 8 of the golf ball shown in FIGS. 1 and 2 and the region proximate thereto. The size of the first predetermined polygon 8 is so set that it is contained in a circle having a diameter of 8 mm. The first predetermined polygon 8 has six apexes and is formed of two predetermined rectangles 9 combined with each other. The two predetermined rectangles 9 overlap each other. The area of the overlapping portion of each predetermined rectangle 9 is less than the half of the area of each thereof. In the golf ball, 100 (2×50) predetermined rectangles 9 can be formed in the large flat portion formed in the region other than the region proximate to the great circle zone 5, without the predetermined rectangles 9 separating from each other and with the predetermined rectangles 9 overlapping each other in an area not more than the half of the entire area of each thereof.

Figure 4:
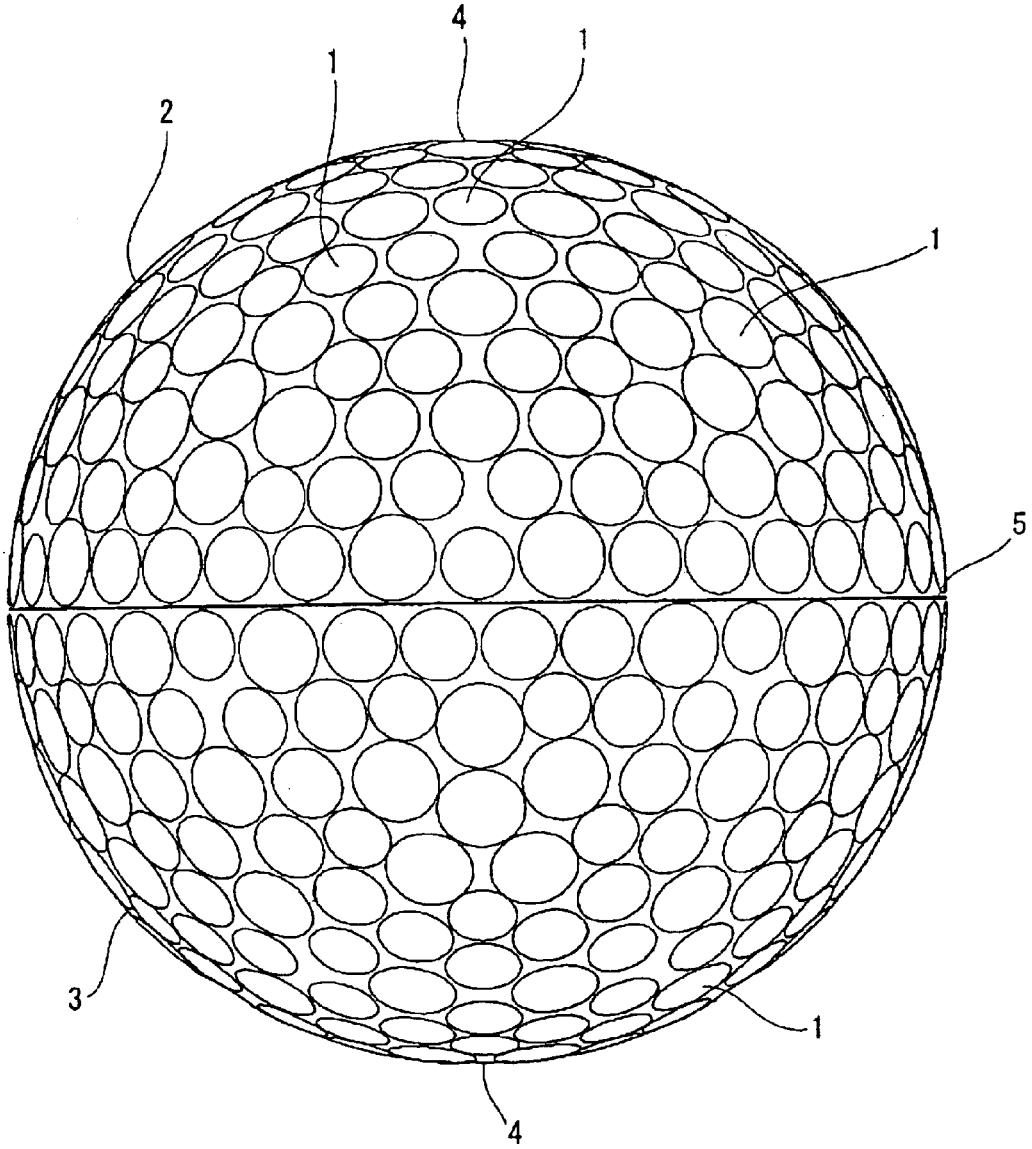
FIG. 4 is a front view showing a golf ball of another embodiment of the present invention.
Figure 5:
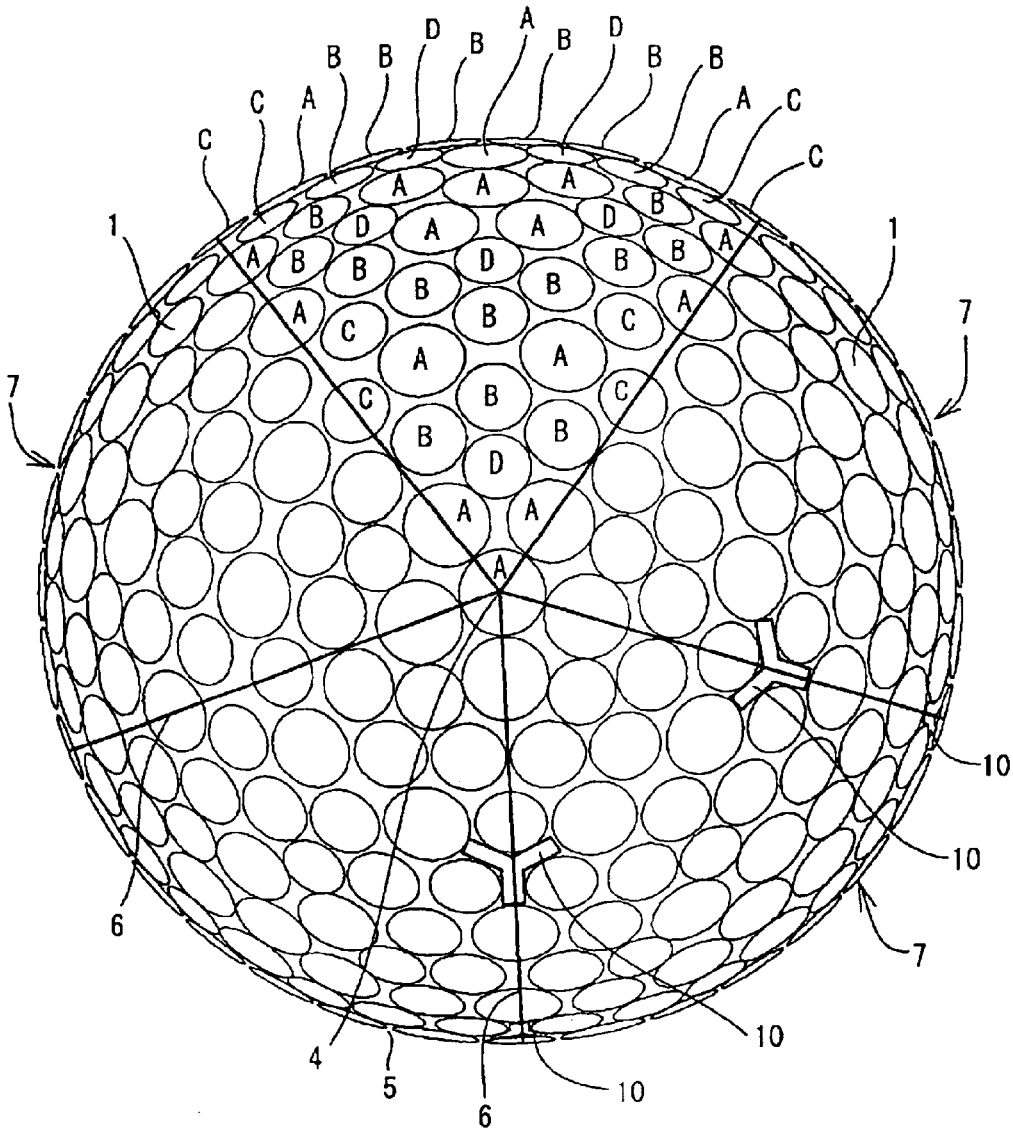
FIG. 5 is a plan view showing the golf ball shown in FIG. 4.

FIG. 4 is a front view showing the golf ball of another embodiment of the present invention. FIG. 5 is a plan view showing the golf ball shown in FIG. 4. Similarly to the golf ball shown in FIGS. 1 through 3, the golf ball of this embodiment has dimples 1, the upper hemisphere 2, the lower hemisphere 3, the poles 4, and the great circle zone 5. Each of the upper hemisphere 2 and the lower hemisphere 3 can be divided into five units 7 by five circular arcs 6 extending from the pole 4 to the great circle zone 5. The golf ball has 132 dimples A each having a diameter 4.00 mm, 180 dimples B each having a diameter 3.4 mm, 60 dimples C each having a diameter 3.30 mm, and 60 dimples D each having a diameter 3.15 mm. The golf ball has 432 dimples.

As shown in FIG. 5, a second predetermined polygon 10 can be formed on the surface of the golf ball. In FIG. 5, four of the second predetermined polygons 10 whose half is included in one unit 7 are drawn. That is, two of the second predetermined polygons (0.5×4) 8 are included in one unit 7. Because the golf ball has five units 7 on its upper hemisphere 2 and its lower hemisphere 3, respectively the golf ball has 10 units 7 in total. Therefore, the number of the second predetermined polygons 10 that can be formed on the golf ball is 20 (2×10). Accordingly, the golf ball has 20 large flat portions present in the region other than the region proximate to the great circle zone 5.

Figure 6:
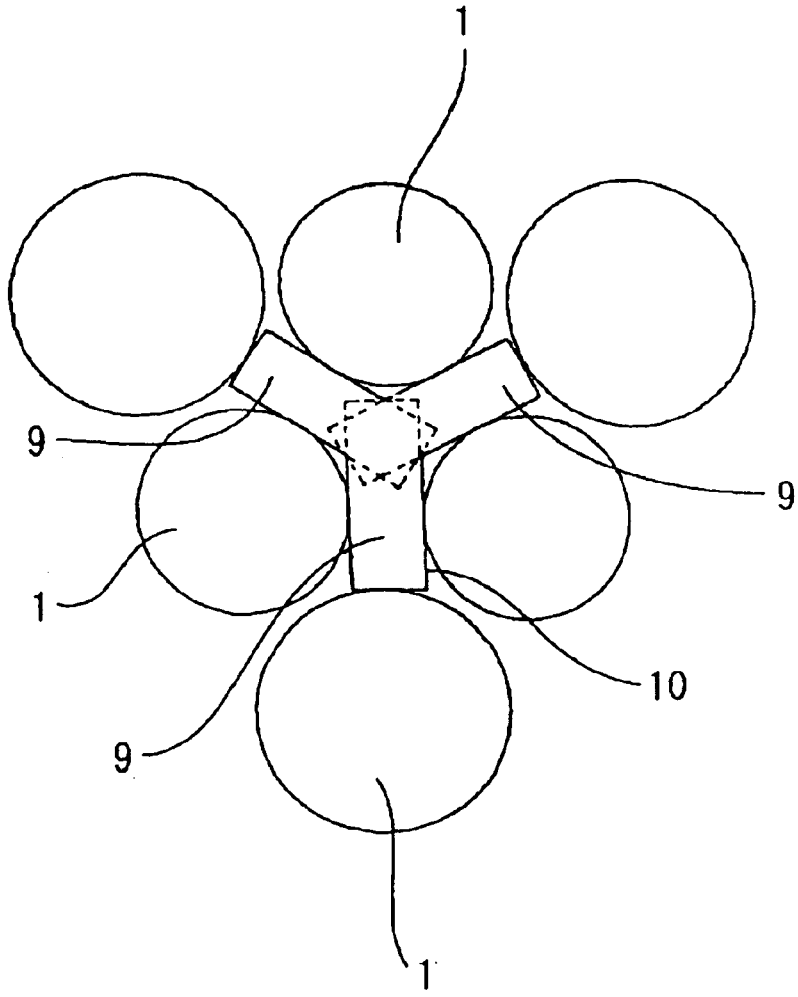
FIG. 6 is an enlarged view showing a second predetermined polygon of the golf ball shown in FIGS. 4 and 5 and the region proximate thereto.

FIG. 6 is an enlarged view showing one of the second predetermined polygons 10 of the golf ball shown in FIGS. 4 and 5 and the region proximate thereto. The size of the second predetermined polygon 10 is so set that it is contained in a circle having a diameter of 8 mm. The second predetermined polygon 10 has nine apexes and is formed of three predetermined rectangles 9 combined with each other. The three predetermined rectangles 9 overlap each other. The area of, the overlapping portion of each predetermined polygon 9 is less than the half of the area of each thereof. In the golf ball, 60 (3×20) predetermined rectangles 9 can be formed in the large flat portion formed in the region other than the region proximate to the great circle zone 5, without the predetermined rectangles 9 separating from each other and with the predetermined rectangles 9 overlapping each other in an area not more than the half of the entire area of each thereof.

Figure 7:
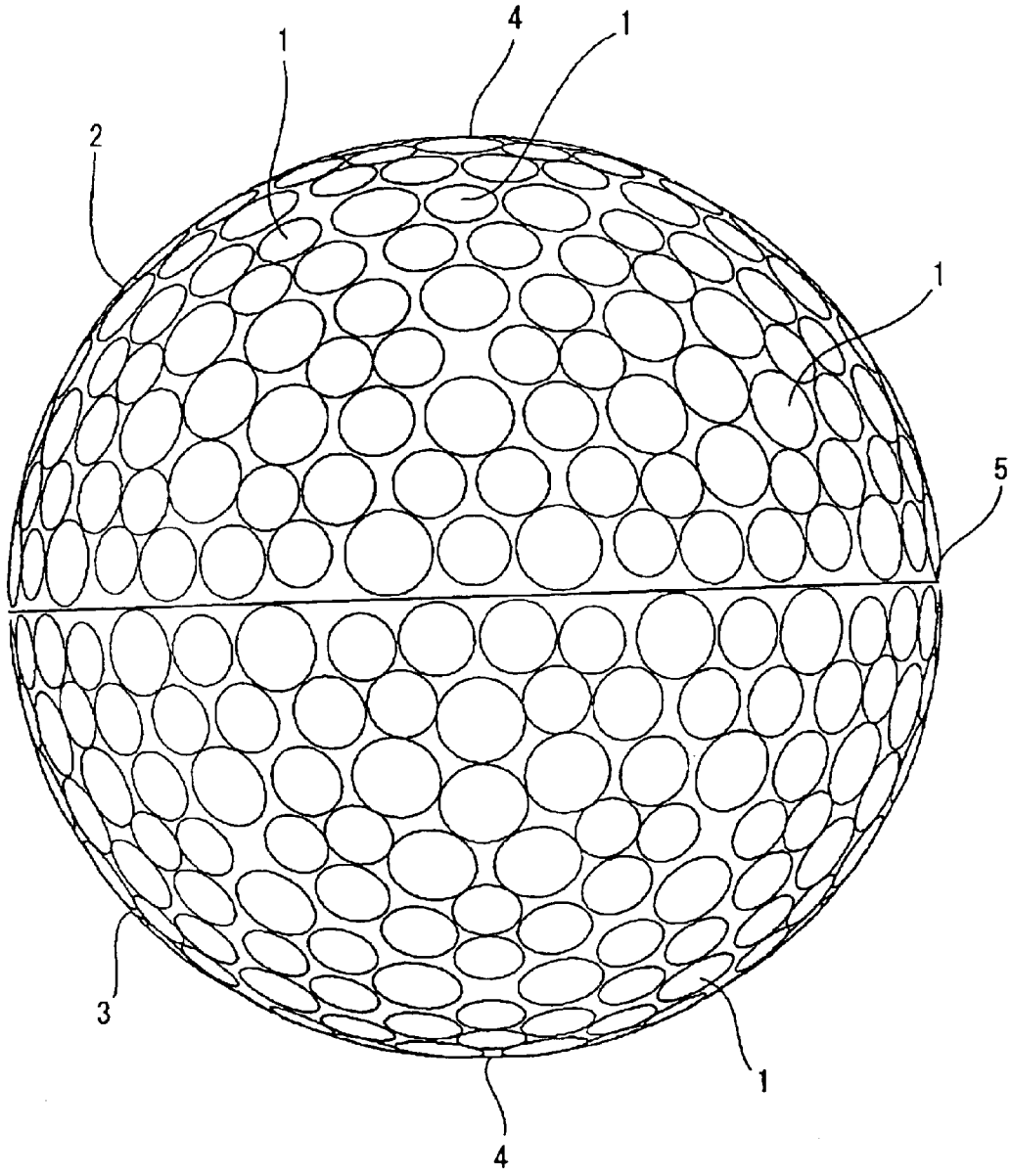
FIG. 7 is a front view showing a golf ball of still another embodiment of the present invention.
Figure 8:
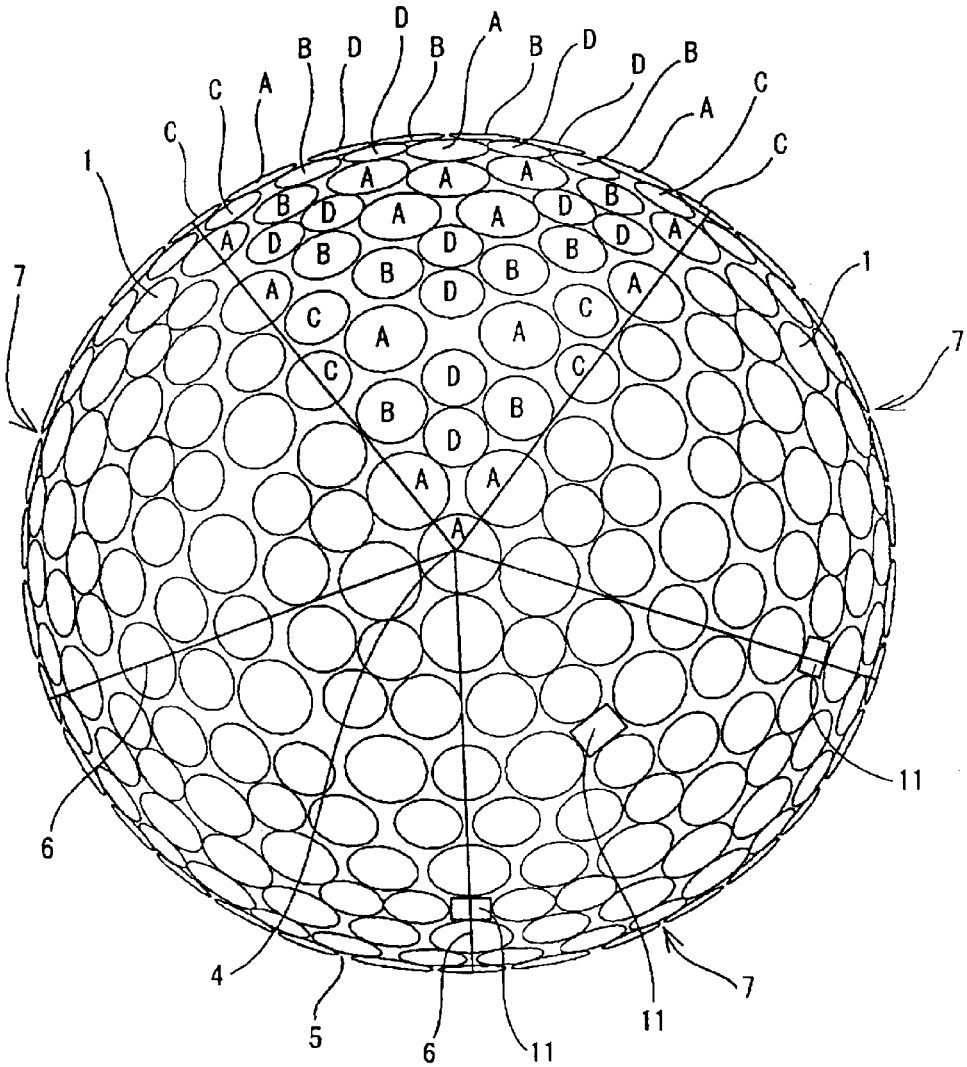
FIG. 8 is a plan view showing the golf ball shown in FIG. 7.

FIG. 7 is a front view showing the golf ball of still another embodiment of the present invention. FIG. 8 is a plan view showing the golf ball shown in FIG. 7. Similarly to the golf ball shown in FIGS. 1 through 3, the golf ball of this embodiment has dimples 1, the upper hemisphere 2, the lower hemisphere 3, the poles 4, and the great circle zone 5. Each of the upper hemisphere 2 and the lower hemisphere 3 can be divided into five units 7 by five circular arcs 6 extending from the pole 4 to the great circle zone 5. The golf ball has 132 dimples A each having a diameter 4.00 mm, 120 dimples B each having a diameter 3.45 mm, 60 dimples C each having a diameter 3.30 mm, and 120 dimples D each having a diameter 3.15 mm. The golf ball has 432 dimples.

As shown in FIG. 8, a third predetermined polygon 11 can be formed on the surface of the golf ball. In FIG. 5, one of the third predetermined polygon 11 whose entirety is included in one unit 7 and two of the third predetermined polygons 11 whose half is included in one unit 7 are drawn. That is, in one unit 7, two of the third predetermined polygons (1+0.5×2) 11 are included in one unit 7. Because the golf ball has five units 7 on its upper hemisphere 2 and its lower hemisphere 3, respectively, the golf ball has 10 units 7 in total. Therefore, the number of the third predetermined polygons 11 that can be formed on the golf ball is 20 (2×10). Accordingly, the golf ball has 20 large flat portions present in the region other than the region proximate to the great circle zone 5.

Figure 9:
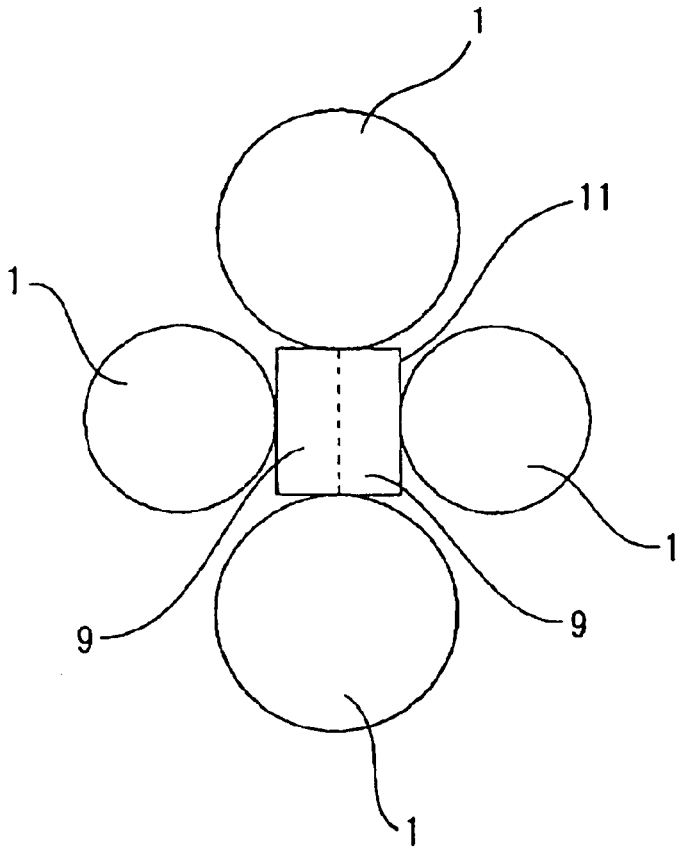
FIG. 9 is an enlarged view showing a third predetermined polygon of the golf ball shown in FIGS. 7 and 8 and the region proximate thereto.

FIG. 9 is an enlarged view showing one of the third predetermined polygons 11 of the golf ball shown in FIGS. 7 and 8 and the region proximate thereto. The size of the third predetermined polygon 11 is so set that it is contained in a circle having a diameter of 8 mm. The third predetermined polygon 11 has four apexes and is formed of two predetermined rectangles 9 combined with each other. The longer sides of the two predetermined rectangles 9 are coincident with each other. The two predetermined rectangles 9 do not overlap each other or spaced from each other. In the golf ball, 40 (2×20) predetermined rectangles 9 can be formed in the large flat portion formed other than the region proximate to the great circle zone 5, without the predetermined rectangles 9 separating from each other and with the predetermined rectangles 9 overlapping each other in an area not more than the half of the entire area of each thereof.

Figure 10:
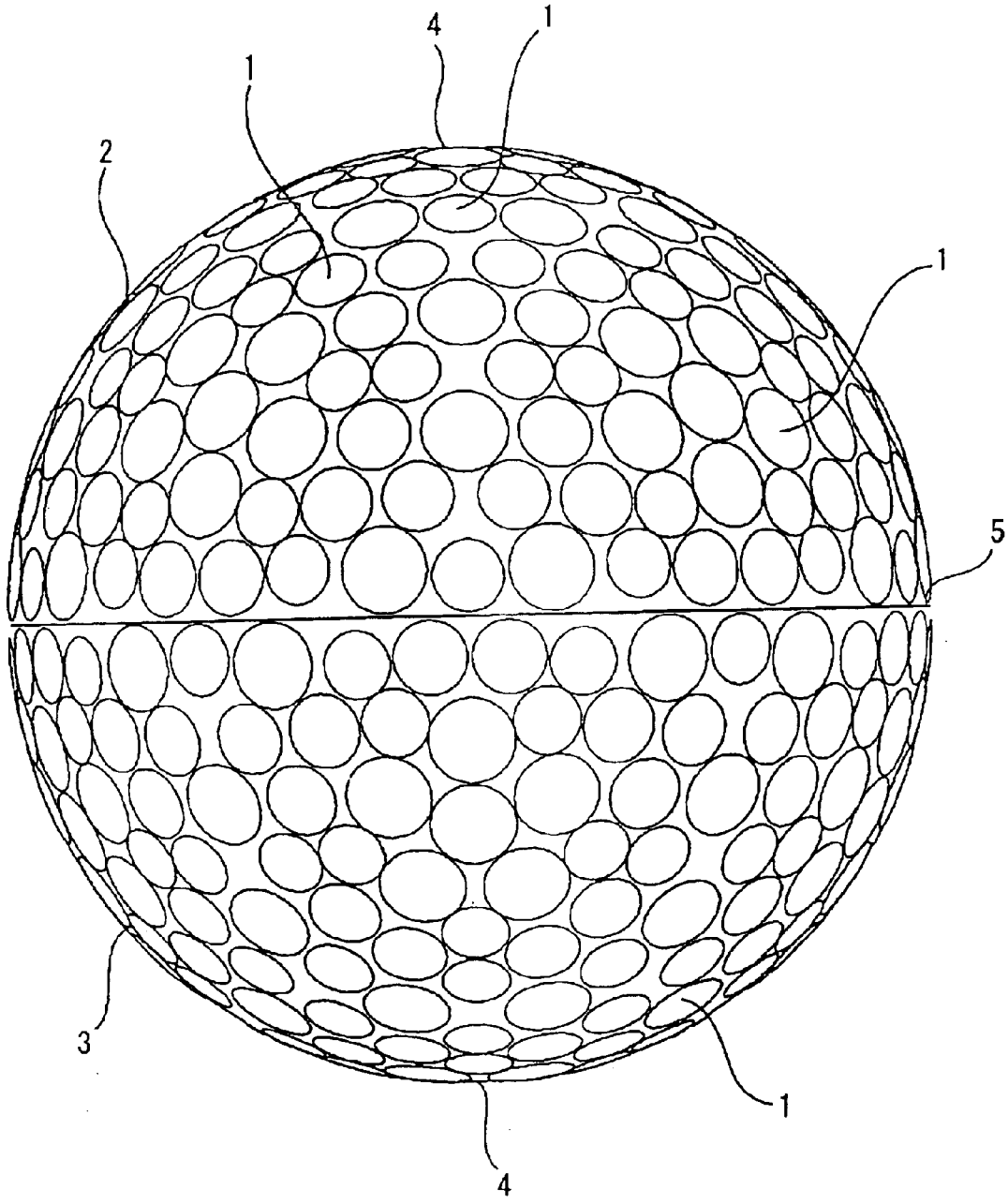
FIG. 10 is a front view showing a golf ball of still another embodiment of the present invention.
Figure 11:
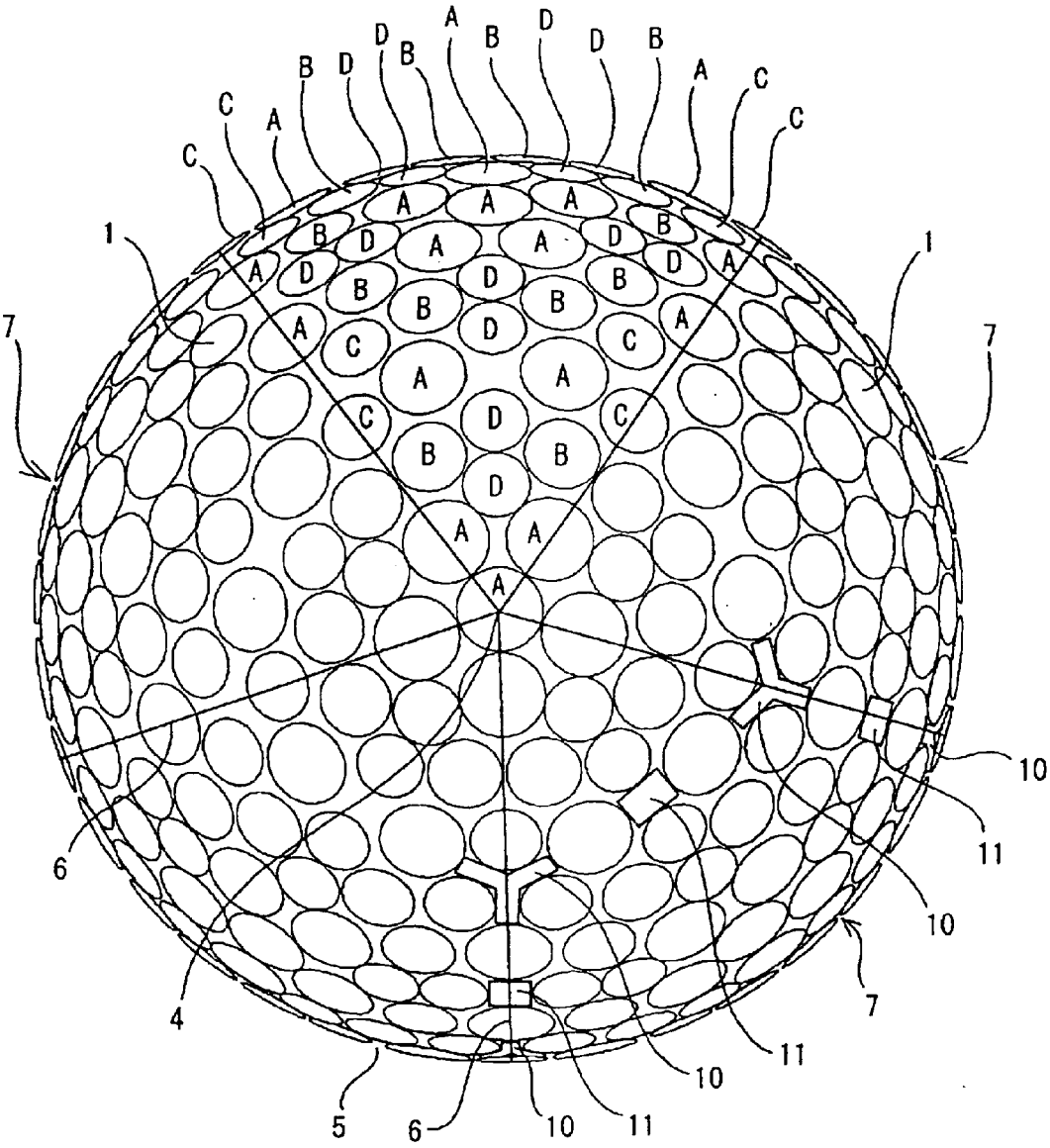
FIG. 11 is a plan view showing the golf ball shown in FIG. 10.

FIG. 10 is a front view showing the golf ball of still another embodiment of the present invention. FIG. 11 is a plan view showing the golf ball shown in FIG. 10. Similarly to the golf ball shown in FIGS. 1 through 3, the golf ball of this embodiment has dimples 1, the upper hemisphere 2, the lower hemisphere 3, the poles 4, and the great circle zone 5. Each of the upper hemisphere 2 and, the lower hemisphere 3 can be divided into five units 7 by five circular arcs 6 extending from the pole 4 to the great circle zone 5. The golf ball has 132 dimples A each having a diameter 4.00 mm, 120 dimples B each having a diameter 3.45 mm, 60 dimples C each having a diameter 3.30 mm, and 120 dimples D each having a diameter 3.15 mm. The golf ball has 432 dimples in total.

As shown in FIG. 11, the second predetermined polygon 10 and the third predetermined polygon 11 can be formed on the surface of the golf ball. In FIG. 11, four of the second predetermined polygons 10 whose half is contained in one unit 7 are drawn. That is, one unit 7 contains two of the second predetermined polygons (0.5×4) 10. One of the third predetermined polygon 11 whose entirety contained in one unit 7 and two third predetermined polygons 11 whose half is included therein are also drawn in FIG. 11. That is, one unit 7 includes two of the third predetermined polygons (1+0.5×2) 11. Four (2+2) predetermined polygons are drawn in one unit 7. Because the golf ball has five units 7 on its upper hemisphere 2 and its lower hemisphere 3, respectively, the golf ball has 40 (4×10) units 7 in total. Therefore, the number of the predetermined polygons that can be formed on the golf ball is 40 (4×10). Accordingly, the golf ball has 40 large flat portions present in the region other than the region proximate to the great circle zone 5.

The second predetermined polygon 10 is formed of three predetermined rectangles 9 combined with each other (see FIG. 6). The third predetermined polygon 11 is formed of two predetermined rectangles 9 combined with each other (see FIG. 9). In the golf ball, 100 (3×20+2×20) predetermined rectangles 9 can be formed in the large flat portion formed other than the region proximate to the great circle zone 5, without the predetermined rectangles 9 separating from each other and with the predetermined rectangles 9 overlapping each other in an area not more than the half of the entire area of each thereof.

EXAMPLES

The effect of the present invention will be described by experiments conducted based on the examples. Needless to say, the present invention should not be restrictively interpreted based on the description of the examples.

First Example

The golf ball prepared in the first embodiment was composed of a core of solid rubber, a cover made of synthetic resin, and a painted layer and had a dimple pattern shown in FIGS. 1 and 2. The diameter of the golf ball was set to 42.70 mm+0.03 mm, and: the compression was set to 85. The depth of the dimple was adjusted in the range of 0.12 mm to 0.18 mm. The total sum of the volumes of dimples was set to 330 $mm^3$. The surface area occupancy percentage of the golf ball, was set to 75.5%. The great circle zone of the golf ball was not visually conspicuous and thus it looked preferable.

Second Example Through Fourth Example

Each of the golf balls of the second through fourth examples was prepared in a manner similar to that of the first example except that the dimple pattern of each of the second through fourth examples was varied from that of the first example, as shown in table 1. The surface area occupancy percentage of each golf ball is as shown in table 1. The great circle zone of any of the golf balls was not visually conspicuous and thus they looked preferable.

First Comparison Example

Figure 12:
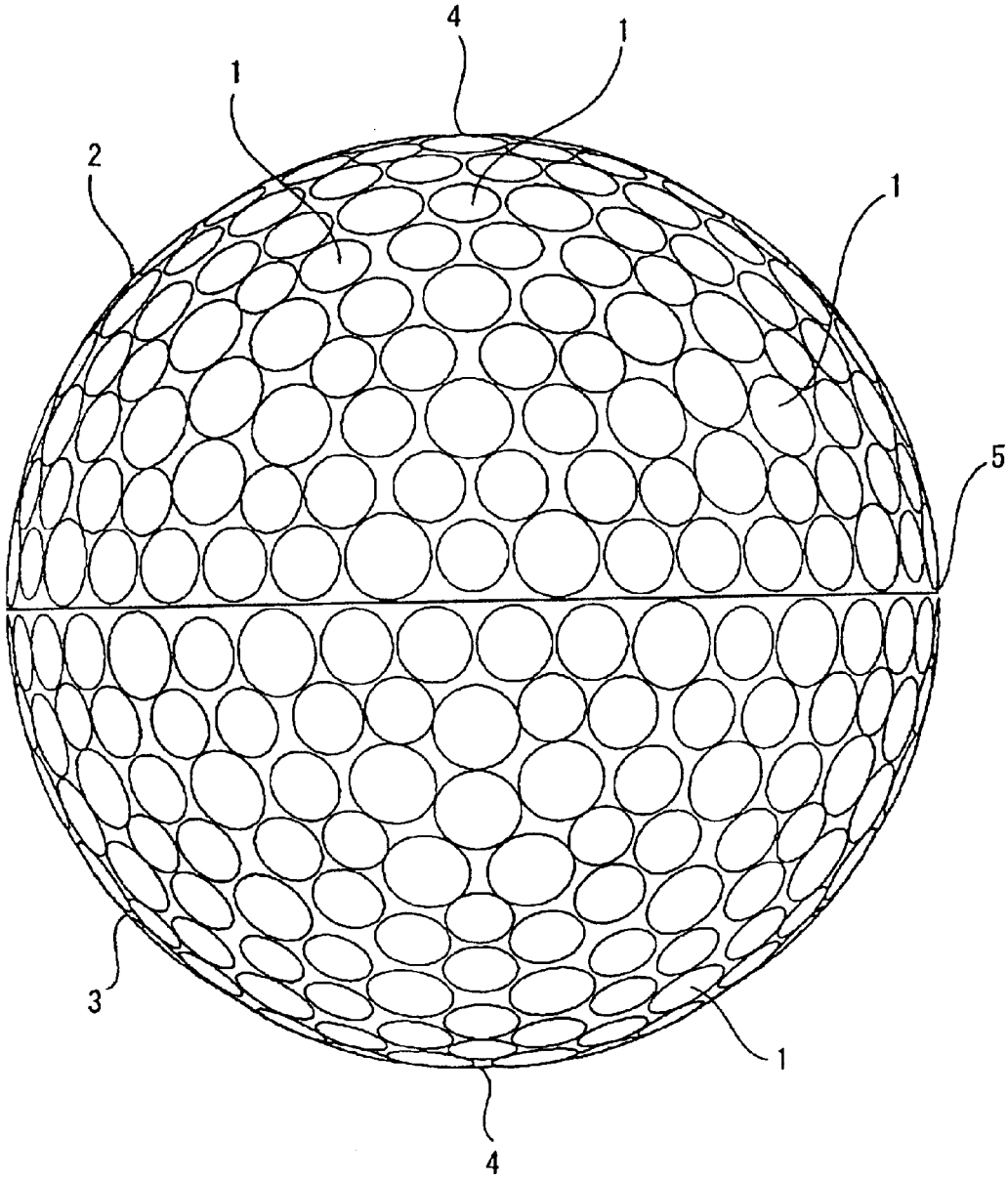
FIG. 12 is a front view showing a golf ball according to a comparison example of the present invention.
Figure 13:
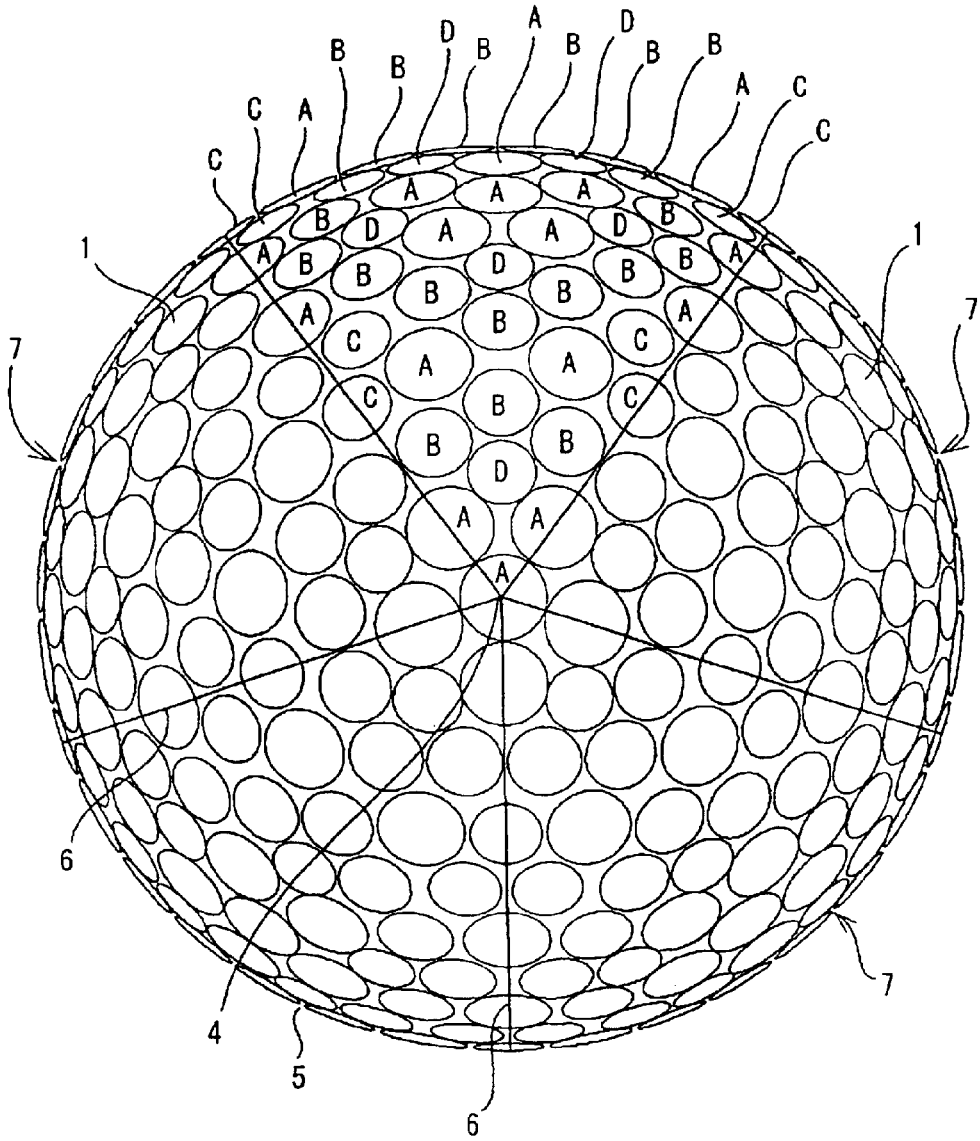
FIG. 13 is a plan view showing the golf ball shown in FIG. 12.

The golf ball of the first comparison example was prepared in a manner similar to that of the first example except that the dimple pattern of the first comparison was as shown in FIGS. 12 and 13. The golf ball of the first comparison example had 132 dimples A each having a diameter 4.00 mm, 180 dimples B each having a diameter 3.45 mm, 60 dimples C each having a diameter 3.30 mm, and 60 dimples D each having a diameter 3.15 mm. Thus, the total sum of the dimples was 432. The surface area occupancy percentage of the golf ball was 75.5%. In the region other than the region proximate to the great circle zone, the golf ball did not have the large flat portion in which predetermined polygons can be formed. The great circle zone of the golf ball was visually conspicuous and thus they looked unpreferable.

Second Comparison Example

Figure 14:
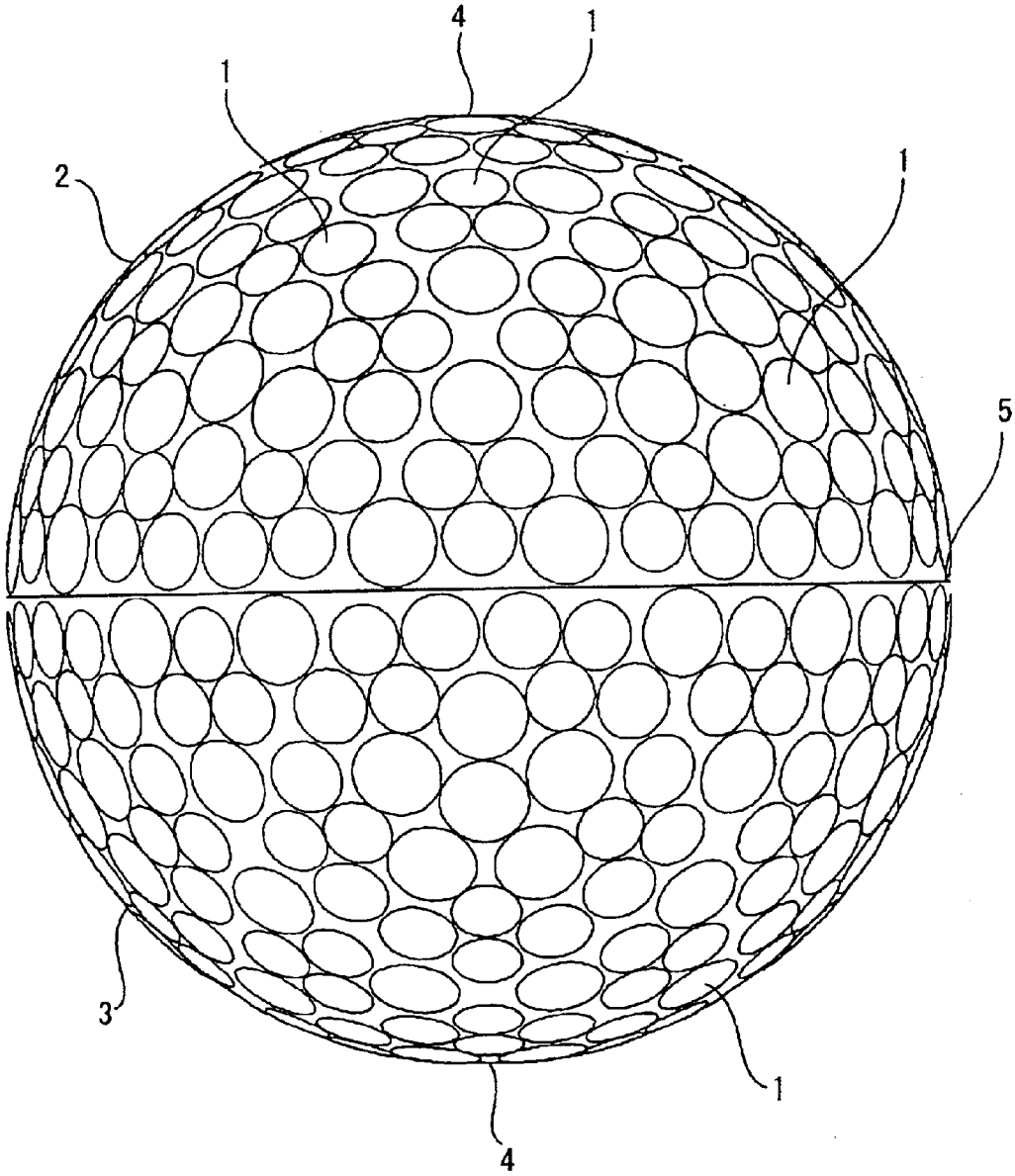
FIG. 14 is a front view showing a golf ball according to another comparison example of the present invention.
Figure 15:
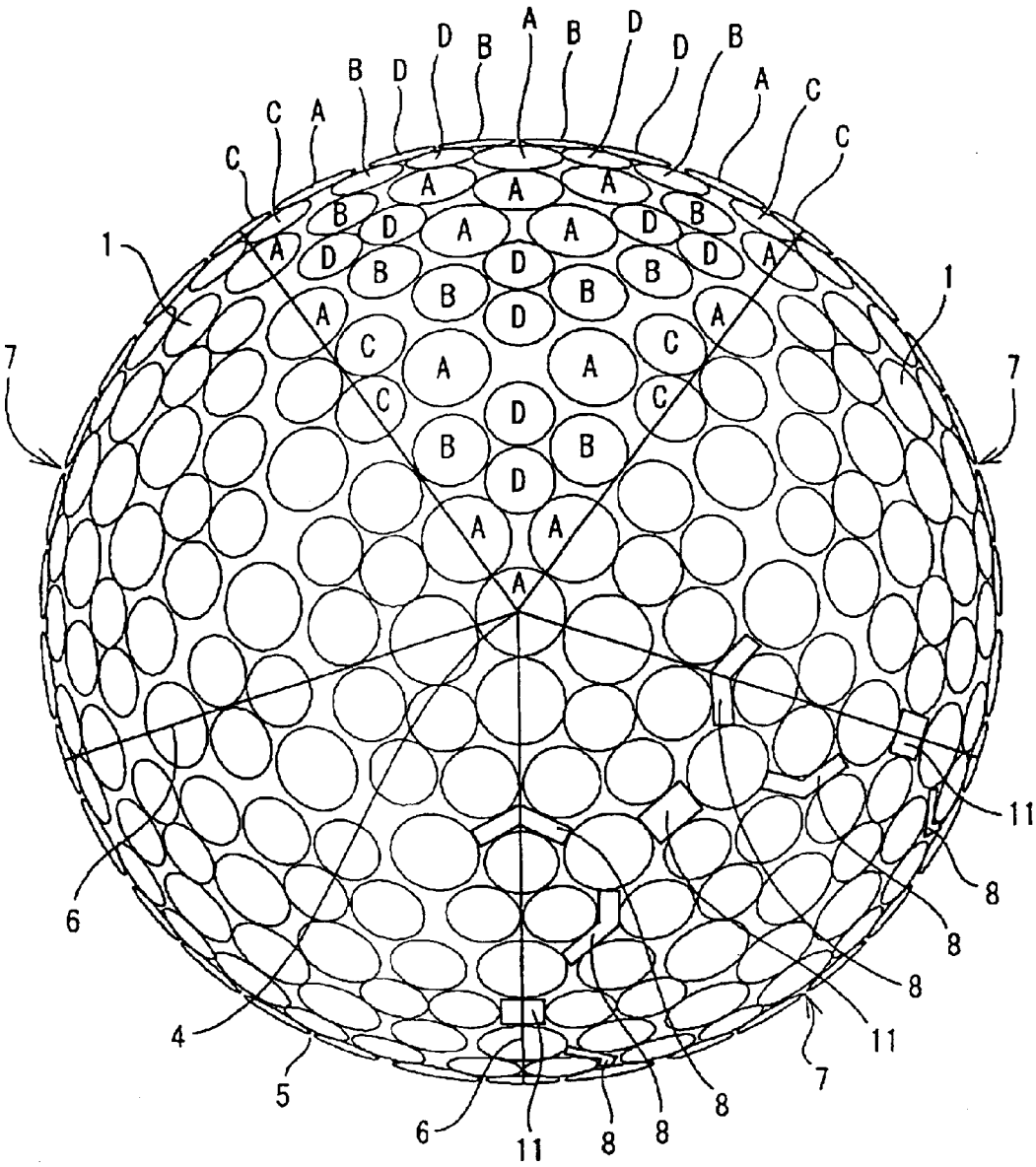
FIG. 15 is a plan view showing the golf ball shown in FIG. 14.

The golf ball of the second comparison example was prepared in a manner similar to that of the first example except that the dimple pattern of the second comparison was as shown in FIGS. 14 and 15. The golf ball of the second comparison example had 132 dimples A each having a diameter 4.00 mm, 120 dimples B each having a diameter 3.45 mm, 60 dimples C each having a diameter 3.30 mm, and 120 dimples D each having a diameter 3.15 mm. Thus, the total sum of the dimples was 432. The surface area occupancy percentage of thee golf ball was 74.0%. In the region other than the region proximate to the great circle zone, the golf ball had 50 large flat portions in which the first predetermined polygons can be formed and had 20 large flat portions in which the third predetermined polygons can be formed. That is, the total sum of the large flat portions present in the region other than the region proximate to the great circle zone is 70. 140 (2×50+2×20) predetermined rectangles were formed in the large flat portions formed in the region other: than the region proximate to the great circle zone, without the rectangles separating from each other and with the rectangles overlapping each other in an area not more than a half of an entire area of each thereof. The great circle zone of the golf ball was not visually conspicuous and thus they looked preferable.

Flight Test

A driver (W1) was installed on a swing robot of servomotor control type manufactured by Golf Laboratories Inc. 12 golf balls of each of the examples and the comparison examples were hit at a head speed of 45 m/s, and the average of the flight distances was computed for each of the examples and the comparison examples. It was windless during the test. The flight distance means the distance between the launching point and the ball-stopped point. Table 1 shows the test result.

TABLE 1

| | Test result of golf balls | | | | | |
|---|---|---|---|---|---|---|
| | E1 | E2 | E3 | E4 | CE1 | CE2 |
| Dimple pattern (front view) | FIG. 1 | FIG. 4 | FIG. 7 | FIG. 10 | FIG. 12 | FIG. 14 |
| Dimple pattern (plan view) | FIG. 2 | FIG. 5 | FIG. 8 | FIG. 11 | FIG. 13 | FIG. 15 |
| Number of dimples (dimple A) | 132 | 132 | 132 | 132 | 132 | 132 |
| Number of dimples (dimple B) | 180 | 180 | 120 | 120 | 180 | 120 |
| Number of dimples (dimple C) | 60 | 60 | 60 | 60 | 60 | 60 |
| Number of dimples (dimple D) | 60 | 60 | 120 | 120 | 60 | 120 |
| Total of dimples | 432 | 432 | 432 | 432 | 432 | 432 |
| Surface area occupancy percentage (%) | 75.5 | 75.5 | 74.0 | 74.0 | 75.5 | 74.0 |
| Number of wide flat portions | 50 | 20 | 20 | 40 | 0 | 70 |
| Number of predetermined rectangles | 100 | 60 | 40 | 100 | 0 | 140 |
| Flight distance (m) | 225 | 226 | 224 | 225 | 223 | 220 |

In the above, E is example and CE is comparison example.

Table 1 indicates that the golf balls of the examples are superior to those of the first and second comparison examples in their flight performance. That is, the golf ball of the present invention is superior to the conventional golf ball.

As apparent from the forgoing description, the golf ball of the present invention is excellent in its flight performance. According to the golf ball of the present invention, it is possible to prevent the difference between the density of dimples arranged in the great circle zone and the density of dimples arranged in the region other than the great circle zone from becoming large. Thus the golf ball looks fine and further, has a preferable aerodynamic symmetrical property.

What is claimed is:

1. A golf ball having 360 or more dimples and only one great circle zone not intersecting with said dimples formed on a surface of said golf ball such that a surface area occupancy percentage of said dimples is 70% or more, wherein rectangles each having a shorter side of 1.0 mm and a longer side of 2.4 mm and not containing any of said dimples are formed in a range of 60 to 100, and large flat portions with said rectangles overlapping each other in an area not more than a half of an entire area of each other and without said rectangles separating from each other aire formed in a range of 20 to 50, said rectangles and large flat portions are formed in a region other than a region proximate to said great circle zone.

2. The golf ball according to claim 1, wherein rectangles each having a shorter side of 1.0 mm and a longer side of 2.4 mm are formed in said large flat portions formed in said region other than said region proximate to said great circle zone, without said rectangles separating from each other and with said rectangles overlapping each other in an area not more than a half of an entire area of each thereof, such that the total of areas of polygons each consisting of a combination of said rectangles lies in the range of 50 $mm^2$ to 400 $mm^2$.

3. The golf ball according to claim 2, wherein rectangles each having a shorter side of 1.0 mm and a longer side of 2.4 mm are formed in said large flat portions formed in said region other than said region proximate to said great circle zone, without said rectangles separating from each other and with said rectangles overlapping each other in an area not more than a half of an entire area of each thereof, such that a diameter of a minimum circle containing said polygon consisting of a combination of said rectangles is 8 mm or less.

4. The golf ball according to claim 1, wherein rectangles each having a shorter side of 1.0 mm and a longer side of 2.4 mm are formed in said large flat portions formed in said region other than said region proximate to said great circle zone, without said rectangles separating from each other and with said rectangles overlapping each other in an area not more than a half of an entire area of each thereof, such that a diameter of a minimum circle containing said polygon consisting of a combination of said rectangles is 8 mm or less.

5. The golf ball according to claim 1, wherein the surface area occupancy percentage of said dimples is 70%–84%.

6. The golf ball according to claim 1, wherein the surface area occupancy percentage of said dimples is 70%–80%.

7. The golf ball according to claim 1, wherein the surface area occupancy percentage of said dimples is 74%–84%.

8. The golf ball according to claim 1, wherein the surface area occupancy percentage of said dimples is 74%–80%.

* * * * *